US008840755B2

(12) United States Patent
Schuldt

(10) Patent No.: US 8,840,755 B2
(45) Date of Patent: Sep. 23, 2014

(54) METHOD FOR PRODUCING CREPE PAPER THAT IS SMOOTH ON ONE SIDE

(75) Inventor: Dirk Schuldt, Kappelrodeck (DE)

(73) Assignee: Papierwerke Lenk AG, Kappelrodeck (DE)

( * ) Notice: Subject to any disclaimer, the term of this patent is extended or adjusted under 35 U.S.C. 154(b) by 0 days.

(21) Appl. No.: 13/807,376

(22) PCT Filed: Jun. 29, 2011

(86) PCT No.: PCT/EP2011/060946

§ 371 (c)(1),
(2), (4) Date: May 23, 2013

(87) PCT Pub. No.: WO2012/001071

PCT Pub. Date: Jan. 5, 2012

(65) Prior Publication Data

US 2013/0228299 A1 Sep. 5, 2013

(30) Foreign Application Priority Data

Jun. 29, 2010 (DE) ..... 10 2010 017 648

(51) Int. Cl.

| | |
|---|---|
| ***D21H 25/00*** | (2006.01) |
| ***B31F 1/12*** | (2006.01) |
| ***B31F 1/14*** | (2006.01) |
| ***D21F 11/14*** | (2006.01) |
| *D21H 25/14* | (2006.01) |
| *D21H 25/04* | (2006.01) |

(52) U.S. Cl.

CPC . *B31F 1/12* (2013.01); *B31F 1/145* (2013.01); *D21H 25/14* (2013.01); *D21H 25/04* (2013.01); *D21H 25/005* (2013.01); *D21F 11/14* (2013.01)

USPC ..... 162/111; 162/204; 156/183; 264/283

(58) Field of Classification Search

CPC ..... D21F 11/006; D21F 11/14; D21F 3/0281; D21F 3/045; D21F 5/02; D21H 25/04; D21H 25/14; D21H 25/005; B31F 1/12; B31F 1/14; B31F 1/145

USPC ..... 162/109, 111–113, 204–205; 156/183; 264/282–283

See application file for complete search history.

(56) References Cited

U.S. PATENT DOCUMENTS 2,892,263 A * 6/1959 Hornbostel ..... 34/120
3,072,522 A * 1/1963 Hornbostel ..... 162/113

(Continued)

FOREIGN PATENT DOCUMENTS

DE 3 03 522 A 2/1918
DE 11 05 700 B 4/1961

(Continued)

*Primary Examiner* — Jose Fortuna

(74) *Attorney, Agent, or Firm* — Factor Intellectual Property Law Group, Ltd.

(57) ABSTRACT

A method for continuously producing crepe paper, comprising the steps of producing a paper web from a material suspension, mechanically dewatering the paper web in a press section, generating a crepe structure in the sheet structure of the paper web, and thermally drying the paper web. The paper web is applied to a glazing cylinder by means of a bulk-preserving pressing system in order to dry and generate a smooth surface on the paper web. The crepe paper is smooth on one side and can be used for a variety of further application areas.

5 Claims, 2 Drawing Sheets

(56) References Cited

U.S. PATENT DOCUMENTS

| | | | | | |
|---|---|---|---|---|---|
| 3,981,084 | A * | 9/1976 | Sobota | 34/123 |
| 4,059,482 | A * | 11/1977 | Kankaanpaa et al. | 162/281 |
| 4,356,059 | A * | 10/1982 | Hostetler | 162/111 |
| 4,420,372 | A * | 12/1983 | Hostetler | 162/280 |
| 4,894,118 | A * | 1/1990 | Edwards et al. | 162/112 |
| 4,919,756 | A * | 4/1990 | Sawdai | 162/111 |
| 5,403,446 | A * | 4/1995 | Trelsmo et al. | 162/281 |
| 5,489,364 | A * | 2/1996 | Marinack | 162/111 |
| 5,507,917 | A * | 4/1996 | Didier et al. | 162/281 |
| 5,690,788 | A | 11/1997 | Marinack et al. | |
| 5,851,353 | A * | 12/1998 | Fiscus et al. | 162/113 |
| 6,287,426 | B1 * | 9/2001 | Edwards et al. | 162/281 |
| 6,368,454 | B1 | 4/2002 | Dwiggins et al. | |
| 6,416,623 | B1 * | 7/2002 | Hollmark et al. | 162/109 |
| 6,432,267 | B1 | 8/2002 | Watson | |
| 6,558,510 | B1 * | 5/2003 | Edwards et al. | 162/111 |
| 6,998,018 | B2 | 2/2006 | Klerelid et al. | |
| 7,591,925 | B2 * | 9/2009 | Scherb et al. | 162/111 |
| 7,691,236 | B2 * | 4/2010 | Conn et al. | 162/281 |
| 7,850,820 | B2 * | 12/2010 | Scherb et al. | 162/117 |
| 7,905,984 | B2 * | 3/2011 | Scherb et al. | 162/111 |
| 8,070,916 | B2 * | 12/2011 | Scherb et al. | 162/263 |
| 8,083,897 | B2 * | 12/2011 | Scherb et al. | 162/280 |
| 2002/0060034 | A1 * | 5/2002 | Hollmark et al. | 162/280 |
| 2002/0104628 | A1 * | 8/2002 | Watson | 162/111 |
| 2003/0098134 | A1 * | 5/2003 | Scherb et al. | 162/117 |
| 2005/0051292 | A1 | 3/2005 | Laithier et al. | |
| 2005/0098282 | A1 * | 5/2005 | Scherb | 162/123 |
| 2006/0243404 | A1 * | 11/2006 | Scherb et al. | 162/111 |
| 2008/0257514 | A1 * | 10/2008 | Scherb et al. | 162/281 |
| 2009/0183847 | A1 * | 7/2009 | Thoroe Scherb et al. | 162/111 |
| 2013/0228299 | A1 * | 9/2013 | Schuldt | 162/111 |

FOREIGN PATENT DOCUMENTS

| | | | |
|---|---|---|---|
| DE | 3112070 | A1 * | 10/1982 |
| DE | 19548747 | A1 * | 7/1997 |
| DE | 102005060379 | A1 * | 6/2007 |

* cited by examiner

METHOD FOR PRODUCING CREPE PAPER THAT IS SMOOTH ON ONE SIDE

RELATED APPLICATIONS

This application claims the filing benefit of International Patent Application No. PCT/EP2011/060946, filed Jun. 29, 2011, which claims the filing benefit of German Patent Application No. 10 2010 017 648.6 filed Jun. 29, 2010, the contents of both of which are incorporated herein by reference.

FIELD OF THE INVENTION

The present invention relates to a method for producing crepe paper which is smooth on one side. In addition, the invention relates to crepe paper which has been produced by the method according to the invention in particular on a paper machine.

BACKGROUND OF THE INVENTION

Crepe paper is known in the prior art and is usually used as technical paper for wrapping, insulating, coating and as support material in particular in roof sheeting, as medical papers for steam and gas sterilisation, dental crepe papers, as gift wrapping paper, packing crepe paper, crepe paper for textile sheath production, as insulating crepe paper for the electrical industry, intermediate layer paper, protective paper, for handicrafts, and for decorating, for paper flowers and the like.

In conventional creping methods, the creping is accomplished by scraping the paper web from a heated cylinder such as, for example, a Yankee cylinder. Depending on the dry content of the paper web, a distinction is made between wet crepe and dry crepe methods.

Disadvantages of creping on both sides can be found, for example, in the area of reprocessing. As a result of the large surfaces unevennesses in crepe papers, for example, the properties with regard to surface imprintability and bondability for paper having creping on both sides is in need of improvement.

It is an object of the present invention to at least partially overcome the disadvantages known in the prior art. The aforesaid object may be solved by a method according to the invention for the continuous production of crepe paper according to one or more embodiments disclosed herein and a paper machine for the production of crepe paper according to one or more embodiments also disclosed herein. Particularly preferred embodiments are further disclosed.

SUMMARY OF THE INVENTION

The method according to the invention for continuously producing crepe paper comprises the steps of producing a paper web from a stock suspension, mechanically dewatering the paper web in a press section, generating a crepe structure in the sheet structure of the paper web and thermally drying the paper web. The method according to the invention for continuously producing crepe paper is characterized in that the creped paper web is applied to a glazing cylinder by means of a bulk-preserving pressing system in order to dry and generate a smooth surface on the paper web.

The paper produced by the method according to the invention is understood as a crepe paper which acquires a shortening of the paper web achieved by the creping, and therefore in particular has an increased stretchability and restoring forces of the paper in the (machine) running direction. The creped paper is as a result, inter alia, more flexible, more compressible, and less sensitive to mechanical loads. The crepe paper is used, for example, for decorative purposes (crepe silk, gardener crepe) for packaging purposes (packaging crepe), as intermediate layer paper, for filtering purposes (coffee filters), for covering work in painting and varnishing, for hygiene (crepe hygiene paper), as hinge material for book backs, as covering paper for roof sheeting, etc.

The production of a paper web from the stock suspension in the sense of the present invention is understood as the process step of dewatering by means of wire(s) and sheet formation during the paper production. The stock suspension is preferably metered via a head box onto (between) a revolving wire and dewatered, which results in the formation of a filter cake. Examples for the corresponding wire sections are longitudinal wire sections, longitudinal wire sections with cover wire or dandy roll, round wire section, round wire sections with round wire formers, duoformers, hybrid formers, combinations hereof and the like.

Mechanical dewatering of the paper web in a press section is understood in the sense of the present invention as all types of dewatering of the web-shaped filter cake by means of pressing methods preferably within a press section of a paper machine. In the press nip the water located in the paper web is pressed out by the pressure applied between the roll pairs. Conventional press systems in paper machines are straight through presses, suction presses, perforated and grooved press rolls, heated press rolls, Flexitherm and NipcoFlex rolls, felted, double-felted, shoe presses, combinations hereof and the like.

Production of a crepe structure in the sheet structure of the paper web in the sense of the invention is understood as the production of crepe folds on a cylinder by means of crepe doctors by compression of the paper web.

In a further embodiment of the method according to the invention for the continuous production of crepe paper, the mechanical dewatering is accomplished by means of at least two, preferably three press nips where at least one roll, in particular the third and last roll of the press section serves as a counter-roller for a crepe doctor and is also designated as crepe roll.

A press nip in the sense of the present invention is understood as the gap between two press rolls, between which the paper web runs and on which a predefined linear force is applied.

A counter-roller for a crepe doctor in the sense of the present invention is understood as a roll against which the crepe doctor abuts which compresses the paper web and produces the creping as a result.

In a further embodiment of the method according to the invention for continuously producing crepe paper, the dry content of the paper web after the drying section lies between 16 and 23% and/or the dry content prior to production of the crepe structure lies between 25 and 45%.

The dry content of the paper web in the sense of the present invention is understood as the dry content of paper and cellulose. The determination is made, for example, according to the standard: BS EN ISO 638 paper, board and pulps—determination of dry matter content—oven drying method.

Thermal drying of the paper web in the sense of the present invention is understood as types of contact drying in the paper machine such as, in particular cylinder drying. For example, other types of drying such as radiation or convention drying can also be used.

Glazing cylinder in the sense of the present invention is understood as heated cylinders having a large diameter and a smooth surface such as, for example, a Yankee cylinder.

In a further embodiment of the method according to the invention for continuously producing crepe paper, the dry content of the paper web before application to a glazing cylinder is in the range between 50 and 80%, preferably between 60 and 75% and in particular in the range of 65 to 70%.

According to the present invention, the creped paper web is applied to a glazing cylinder where this is accomplished by means of a bulk-preserving pressing system. A bulk-preserving pressing system is understood in this case, as a pressing system which substantially does not destroy the creping of the crepe paper and maintains the volume of the crepe paper in a predefined scope. This is achieved, for example, by the combination of a soft press roll with a Velin felt in the press nip between press roll and Yankee cylinder. An example for the arrangement of such a pressing system is a Deutsche press or a corresponding modification thereof. With patterns of the crepe paper according to the invention, for example, Bendtsen smoothness values in the range of 20 to 1500 ml/min, preferably of 100 to 1200 ml/min and in particular in the range of 500 to 900 ml/min were measured. Gloss values measured in accordance with DIN 54502 with an angle of incidence of 85 degrees for samples of the crepe paper according to the invention were measured, for example, in the range of 0 to 25, preferably 1 to 23 and in particular in the range of 6 to 22.

Gloss of the paper web in the sense of the present invention is understood as the gloss of the crepe paper as an optical impression which is perceived when examining the surface. The determination is made, for example, in accordance with the standard: DIN 54502.

In a further embodiment of the method according to the invention for continuously producing crepe paper, the crepe structure has a crepe factor in the range of 1 to 20% and in particular the fibre orientation in the paper web has a longitudinal/transverse ratio in the range of 1:1 to 1:2.5.

Crepe factor of the crepe structure in the sense of the present invention is understood as the percentage ratio between the uncreped and the creped paper web, where in particular a shortening of the paper web is brought about by the creping.

Fibre orientation in the sense of the present invention is understood as the ratio between the fibre orientation longitudinally to the fibre orientation and transversely to the paper machine. The fibre orientation is determined in the sheet forming process in the paper machine and can be determined, for example, by image analysis methods, laser scattering methods etc.

In a further embodiment of the method according to the invention for continuously producing crepe paper, the crepe doctor has a grinding angle $\alpha$ in the range of 0.5° to 10°, in particular between 3° and 8° and/or the angle of attack $\gamma$ is from 20° to 30° and/or the angle of attack $\beta$ is between 5° to 20°, in particular occupies about 14°.

Grinding angle $\alpha$ (alpha) in the sense of the present invention is understood as the angle of the ground crepe doctor edge.

Angle of attack $\gamma$ (gamma) in the sense of the present invention is understood as the angle of the crepe doctor to the counter-roller.

Angle of attack $\beta$ (beta) in the sense of the present invention is understood as the angle of incidence of the crepe doctor to the vertical axis of the counter-roller.

The object of the present invention may be further solved by a paper machine for producing a crepe paper. This comprises at least one head box, a wire section for producing a paper web from a stock suspension, a press section for mechanical dewatering, a device for producing a crepe structure in the paper web, a drying section for thermal dewatering of the paper web, a pressing system and a glazing device. The glazing device comprises at least one glazing cylinder which, with a pressing system, applies the creped paper web with a soft roller and/or a spare felt to the glazing cylinder to produce a smooth surface.

Soft roller in the sense of the present invention is understood as a roller having a soft coating in the region of 10 to 30 Pusey & Jhone.

Spare felt is understood in the sense of the present invention which in particular spares the crepe paper web in relation to the paper-specific volume or the crepe structure. Here, for example, a Velin felt is used into which, as a result of its compressibility, one side of the crepe paper web can be pressed into the press nip and thus the crepe paper web is protected from the pressure effect in the press nip. According to a further preferred embodiment, the spare felt can also have a ribbing or other surface structure in order to give the crepe paper a further, in particular visible, structure or marking.

In a further embodiment of the paper machine according to the invention, at least one further thermal drying device, a size press, a glazing unit and a reel are provided.

A further thermal drying device in the sense of the present invention is understood, for example, as an after-drying section.

Size press is understood in the sense of the present invention as a roll application unit, for example, for the application of dry solidification additives.

Glazing unit is understood in the sense of the present invention, for example as a roller glazing unit.

Reel in the sense of the present invention is understood as a device for reeling the finished paper web such as for example a Pope reel winder.

In a further embodiment of the paper machine according to the invention, the press section comprises a first press, in particular having a linear force in the range of 0 to 10 kN/m for producing a dry content in the range of 25 to 30%, a second press, in particular having a linear force in the range of 35 to 45 kN/m for producing a dry content in the range of 27 to 38% and preferably a third press, in particular having a linear force in the range of 45 to 55 kN/m for producing a dry content in the range of 25 to 45%.

Linear force in the sense of the present invention is understood as the force which is applied to the line in the press nip.

In a further embodiment of the paper machine according to the invention, at least one roller of the press section is configured as a crepe roller, in particular having a refined surface. Examples of materials from which these refined surfaces are at least partially produced are tungsten carbide compounds, in particular di-tungsten carbide, tungsten monocarbide, fused tungsten carbide combinations hereof and the like.

In a further embodiment of the paper machine according to the invention, a crepe doctor is used for the production of the crepe structure, which in particular has a ceramically coated doctor edge.

In a further embodiment of the paper machine according to the invention, the crepe doctor has a grinding angle $\alpha$ (alpha) in the range of 0.5° to 10°, in particular between 3° and 8° and/or the angle of attack $\gamma$ (gamma) from 20° to 30° and/or the angle of attack $\beta$ between 5° to 20°, in particular about 14°.

In a further embodiment of the paper machine according to the invention, before application of the crepe paper to a glazing cylinder, the paper machine has a pre-drying, in particular a cylinder drying, for producing a dry content of the crepe paper web according to the invention in the range between 50 and 80%, preferably between 60 and 75%, and in particular in the range from 65 to 70%.

Cylinder drying in the sense of the present invention is understood as heated drying cylinders which are used in a paper machine for drying the paper web.

In a further embodiment of the paper machine according to the invention, the soft roller is part of a Deutsche press which applies the paper web to the glazing cylinder, in particular the Yankee cylinder. Further in particular a spare felt such as, for example, a Velin felt is used where preferably the linear force between press and cylinder lies in the range of 5 to 20 kN/m.

Furthermore, the method according to the invention for continuously producing crepe paper also comprises the crepe paper which has been produced by this method which has preferably been produced on a paper machine according to the invention.

The present invention further also comprises the use of the crepe paper as technical paper for wrapping, insulating, coating and as support material in particular in roof sheeting, as medical papers for steam and gas sterilisation, dental crepe papers, as gift wrapping paper, packing crepe paper, crepe paper for textile sheath production, as insulating crepe paper for the electrical industry, for the lamination of paper, board and card, as coloured paper, as damp proof paper, as hydrophobic paper, security paper, for packaging, as well as for handicrafts, and for decorating, for paper flowers and the like.

An advantage of the method for producing crepe paper according to the invention is that the crepe paper is smooth on one side and with the surface properties thereby modified for example can be used for a plurality of further areas of application. These are, for example, the laminatability of the crepe paper, the possibility of coating, in particular roller coating, the imprintability of the crepe paper and a potential bondability of the crepe paper.

An advantage of the method according to the invention is the production of gloss properties as a visual impression of crepe paper which is perceived when examining the surface.

It is to be understood that the aspects and objects of the present invention described above may be combinable and that other advantages and aspects of the present invention will become apparent upon reading the following description of the drawings and detailed description of the invention.

The invention is explained hereafter with reference to a preferred exemplary embodiment where it is noted this example also covers modifications or additions such are deduced directly for the person skilled in the art. Furthermore, this preferred exemplary embodiment does not form any restriction of the invention in such a manner that modifications and additions lie within the scope of the present invention.

DETAILED DESCRIPTION OF THE PRESENT INVENTION

Figure 1:
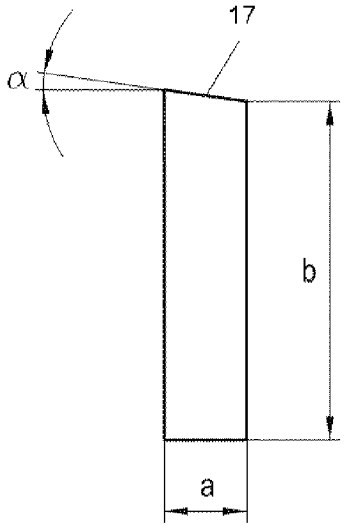
FIG. 1 shows a schematic drawing of the crepe doctor blade used in the method according to the invention.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The exemplary embodiment according to FIG. 1 shows a crepe doctor 5 having a doctor edge 17, a grinding angle $\alpha$ between 3° and 8°, a thickness a between 0.6 to 1 mm and a length b between 70 to 75 cm. The phase of the grinding angle can, for example, be coated. Suitable as abrasion-proof coating material, for example, are ceramic materials which are selected from a group which comprise abrasion-proof compounds, which in particular comprise silicate compounds, which in particular comprise carbide compounds, which in particular comprise silicon carbide compounds, boron carbide compounds, aluminium oxide compounds, beryllium oxide compounds, zirconium oxide compounds, boron nitride compounds, kaolinite compounds, illite compounds, montmorillonite compounds, quartz compounds, feldspar compounds, mica compounds, chalk compounds, combinations hereof and the like.

Figure 2:
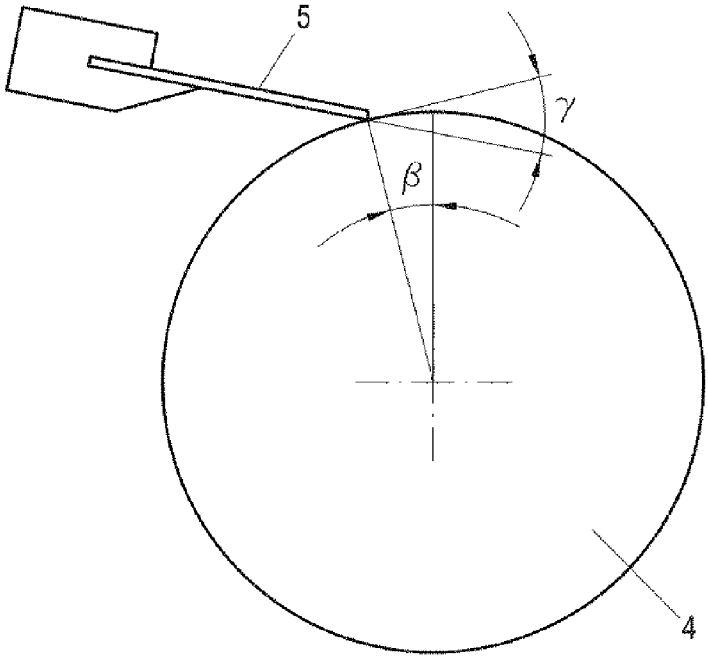
FIG. 2 shows a schematic drawing of the apparatus used in the method according to the invention for producing a crepe structure and the positioning of the crepe doctor to the counter-roller.

The exemplary embodiment according to FIG. 2 shows an apparatus for producing a crepe structure 7. This apparatus consists of a crepe doctor 5 and a counter-roller 4 which can also be designated as crepe roller or in the present example as press roll. The positioning of the crepe doctor 5 is adjusted by means of the angle of attack $\beta$ which is, for example 10° to 20°, in particular 14° and the angle of attack $\gamma$ which is, for example, 20° to 30°. The adjustment of the angle is carried out, for example, with the positioning of an adjustable scraper beam. In order to permanently withstand the mechanical loading by the scraper 5, the surface of the counter-roller 4 can also be coated with a particularly resistant material—similarly to the doctor 5—at least partially.

Figure 3:
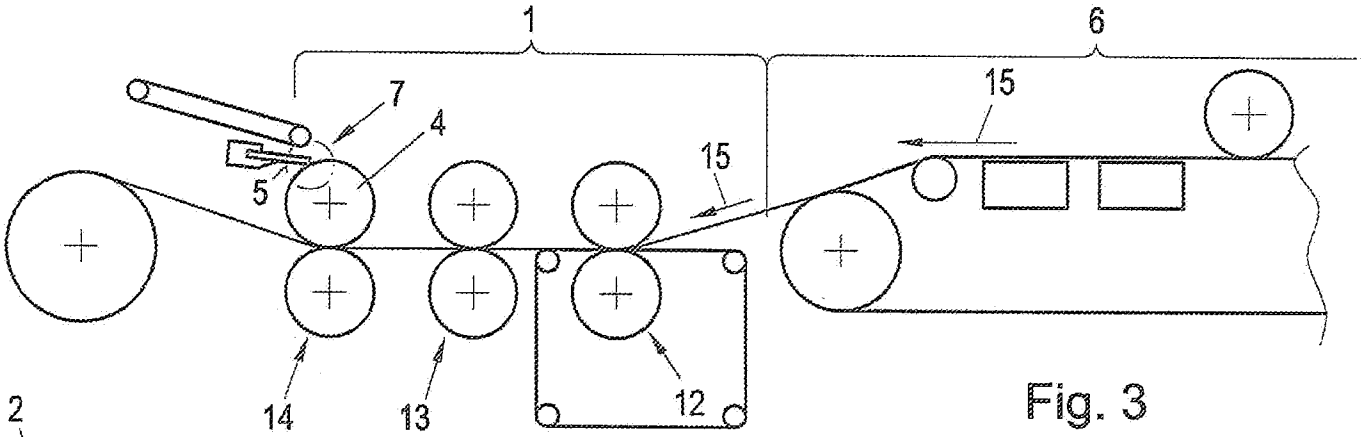
FIG. 3 shows a schematic drawing of the front part of the paper machine used in the method according to the invention.

The diagram according to FIG. 3 shows the front part of a paper machine comprising a wire section 6 in which the first dewatering of a stock suspension is carried out by (a) wire(s). In the press section 1 the dry content of the previously formed (paper) web is increased with a second mechanical dewatering process. The press section 1 consists, for example, of a first press 12, here shown with an underfelt, a second press 13 and a third press 14. As the (paper) web runs along the arrow 15 through each individual press nip of the aforesaid press, the dry content of the paper web is gradually increased to 25-45%. In the present exemplary embodiment the creping takes place at the third press 14 at which the apparatus for producing a crepe structure 7 is attached. This apparatus consists in the present example of a crepe doctor 5 and a counter-roller 4 which are positioned with angles of attack to one another. From the press section 1 the paper web is transferred, for example, into the dry section 8 of FIG. 4.

Figure 4:
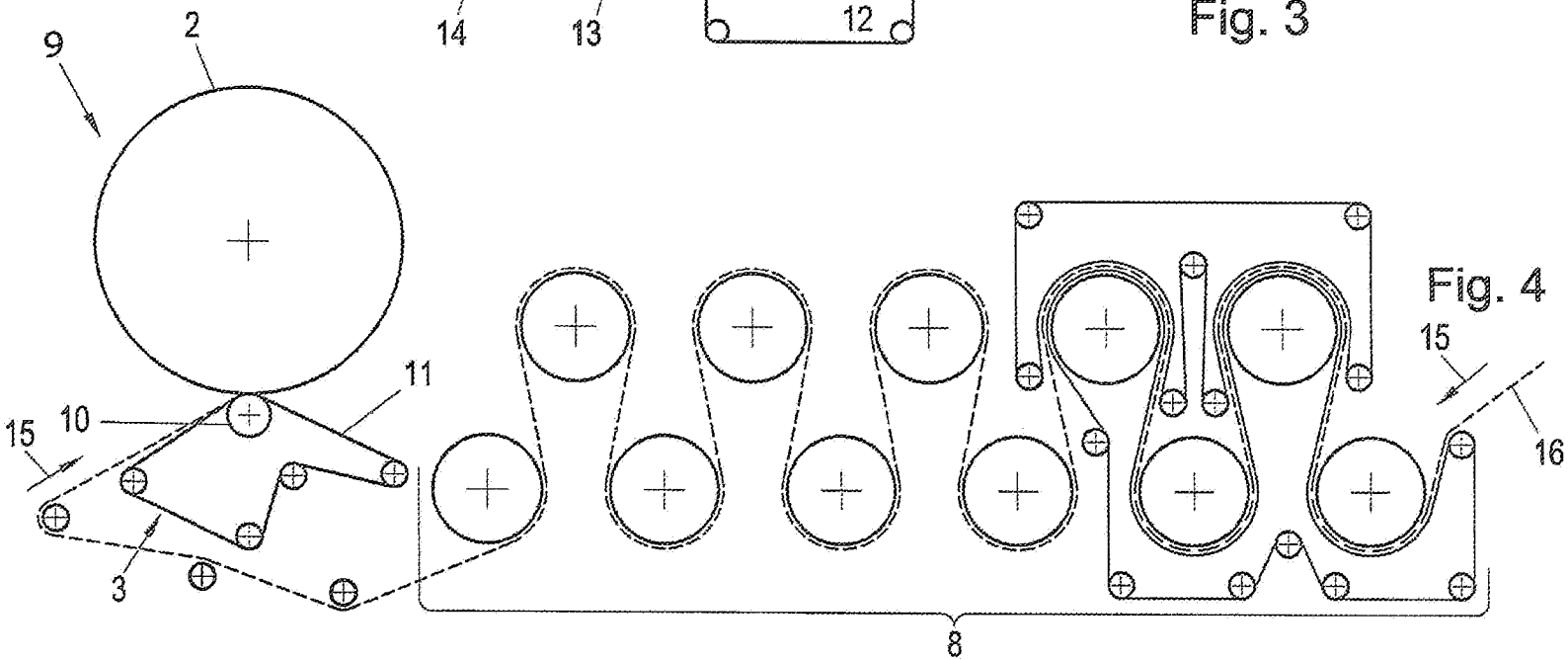
FIG. 4 shows a schematic drawing of the thermal drying with a glazing cylinder.

The diagram according to FIG. 4 shows the course of the paper web 16 through a dry section 8 in which, for example a slalom felt guide in installed in the first four dry cylinders. A glazing device is further installed following the drying. The glazing device 9 comprises a glazing cylinder 2 and a bulk-preserving pressing system 3 with which the crepe paper web is pressed against the glazing cylinder 2. The bulk-preserving pressing system 3 here comprises a spare felt 11 and a soft roll 10.

Table 1 shows an overview of the parameters of crepe paper according to the method according to the invention. For the type of paper white gloss on one side (one-sided gloss white=ogls white) for example, the paper parameters achieved, Bendtsen roughness (ml/min) and gloss measured in accordance with DIN 54502 are given for different grammages in each case relative to the paper upper side (OS) and paper underside (US) with the adjusted machine parameters Yankee cylinder pressure (bar abs.), contact pressure of the press roll (KN/m) and cylinder surface temperature (° C.). For the crepe paper according to the invention, the Bendtsen roughness and/or the gloss values according to DIN 54502 are significantly improved compared with the prior art.

TABLE 1

Parameters of crepe paper samples produced by the method according to the invention.

| Paper designation | Paper side OS (upper side) or US lower side) | Grammage in g/m$^2$ | Bendtsen roughness in ml/min | Yankee cylinder pressure in bar abs. | Contact pressure of the press roll in KN/m | Cylinder surface temperature in ° C. | Gloss measurement according to DIN 54502 angle of incidence 85 deg |
|---|---|---|---|---|---|---|---|
| ogls | OS | 40 | 2270 | 3.5 | 60 | 120 | 0 |
| white | US | | 310 | | | | 22 |
| ogls | OS | 40 | 4340 | 2 | 20 | 92 | 0 |
| white | US | | 790 | | | | 6 |
| ogls | OS | 60 | 2420 | 3.6 | 59 | 126 | 1 |
| white | US | | 270 | | | | 23 |
| ogls | OS | 60 | 4190 | 1.9 | 22 | 94 | 0 |
| white | US | | 830 | | | | 7 |
| ogls | OS | 100 | 2030 | 3.4 | 61 | 119 | 2 |
| white | US | | 250 | | | | 25 |
| ogls | OS | 100 | 4310 | 2 | 21 | 89 | 0 |
| white | US | | 790 | | | | 7 |

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A method for continuously producing crepe paper that is smooth on one side, comprising the steps:

producing a paper web from a stock suspension;

mechanically dewatering the paper web in a press section;

generating a crepe structure in the sheet structure of the paper web with a crepe doctor;

thermally drying the paper web; and, applying the paper web to a glazing cylinder with a bulk-preserving pressing system comprising a soft roller and a spare felt such that a smooth side is generated only on a single side of the paper web;

wherein, a dry content prior to production of the crepe structure is between 25 and 45%.

2. The method for producing a crepe paper according to claim 1, wherein the mechanical dewatering is accomplished with at least two press nips and at least one roller of a press section serves as a counter-roller for the crepe doctor.

3. The method for producing crepe paper according to claim 1, wherein the dry content of the paper web after a drying section lies between 16 and 23%.

4. The method for producing a crepe paper according to claim 1, wherein the crepe structure has a factor in a range of 1 to 20% and a fibre orientation in the paper web has a longitudinal/transverse ratio in the range of 1:1 to 1:2.5.

5. The method for producing crepe paper according to claim 1, wherein the crepe doctor has a grinding angle $\alpha$ in the range of 0.5° to 10° and/or an angle of attack $\gamma$ is from 20° to 30° and/or an angle of attack $\beta$ is between 5° to 20°.

* * * * *